US007431812B2

(12) United States Patent
Nguyen et al.

(10) Patent No.: US 7,431,812 B2
(45) Date of Patent: Oct. 7, 2008

(54) SURFACE OXIDISED NICKEL-IRON METAL ANODES FOR ALUMINIUM PRODUCTION

(75) Inventors: Thinh T. Nguyen, Onex (CH); Vittorio De Nora, Nassau (BS)

(73) Assignee: Moitech Invent S.A. (LU)

( * ) Notice: Subject to any disclaimer, the term of this patent is extended or adjusted under 35 U.S.C. 154(b) by 595 days.

(21) Appl. No.: 10/506,146

(22) PCT Filed: Mar. 12, 2003

(86) PCT No.: PCT/IB03/00964

§ 371 (c)(1),
(2), (4) Date: Aug. 31, 2004

(87) PCT Pub. No.: WO03/078695

PCT Pub. Date: Sep. 25, 2003

(65) Prior Publication Data

US 2005/0205431 A1 Sep. 22, 2005

(30) Foreign Application Priority Data

Mar. 15, 2002 (WO) ..... PCT/IB02/00820
Jul. 23, 2002 (WO) ..... PCT/IB02/02972

(51) Int. Cl.
*C25B 11/04* (2006.01)
*C22C 19/03* (2006.01)
*C22C 38/08* (2006.01)

(52) U.S. Cl. ..... 204/293; 204/243.1; 205/384; 205/385; 420/43; 420/60; 420/80; 420/89; 420/92; 420/94; 420/441; 420/452; 420/458; 420/459

(58) Field of Classification Search ..... 205/384, 205/385; 204/293, 243.1; 420/43, 60, 80, 420/89, 92, 94, 441, 452, 458, 459
See application file for complete search history.

(56) References Cited

U.S. PATENT DOCUMENTS 5,510,008 A * 4/1996 Sekhar et al. ..... 205/384
5,904,828 A * 5/1999 Sekhar et al. ..... 205/188
6,248,227 B1 * 6/2001 de Nora et al. ..... 205/230
6,692,631 B2 * 2/2004 Bergsma ..... 205/385

OTHER PUBLICATIONS

J.R. Davis, ASM Specialty Handbook, Dec. 2000, pp. 1-3, Table 2.*

* cited by examiner

*Primary Examiner*—Bruce F. Bell
(74) *Attorney, Agent, or Firm*—Jayadeep R. Deshmukh

(57) ABSTRACT

An anode for the electrowinning of aluminium by the electrolysis of alumina in a molten fluoride electrolyte has an electrochemically active integral outside oxide layer obtainable by surface oxidation of a metal alloy which consists of 20 to 60 weight % nickel; 5 to 15 weight % copper; 1.5 to 5 weight % aluminium; 0 to 2 weight % in total of one or more rare earth metals, in particular yttrium; 0 to 2 weight % of further elements, in particular manganese, silicon and carbon; and the balance being iron. The metal alloy of the anode has a copper/nickel weight ratio in the range of 0.1 to 0.5, preferably 0.2 to 0.3.

41 Claims, No Drawings

SURFACE OXIDISED NICKEL-IRON METAL ANODES FOR ALUMINIUM PRODUCTION

FIELD OF THE INVENTION

This invention relates to surface oxidised nickel-iron metal anodes for the electrowinning of aluminium by the electrolysis of alumina dissolved in a molten fluoride-containing electrolyte, an aluminium electrowinning cell with such an anode and its use to produce aluminium.

BACKGROUND ART

Using non-carbon anodes in aluminium electrowinning cells should drastically improve the aluminium production process by reducing pollution and the cost of aluminium production. Many attempts have been made to use oxide anodes, cermet anodes and metal-based anodes for aluminium production, however they were never adopted by the aluminium industry.

U.S. Pat. Nos. 6,248,227 and 6,436,274 (both de Nora/Duruz) disclose a non-carbon, metal-based slow-consumable anode of a cell for the electrowinning of aluminium that self-forms during normal electrolysis an electrochemically-active oxide-based surface layer. The rate of formation of this layer is maintained substantially equal to its rate of dissolution at the surface layer/electrolyte interface thereby maintaining its thickness substantially constant.

A different approach was taken in WO 00/06802 (Duruz/de Nora/Crottaz) where anodes comprising a transition metal-based oxide active surface of iron oxide, cobalt oxide, nickel oxide or combinations thereof, were kept dimensionally stable during electrolysis by continuously or intermittently feeding to the electrolyte a sufficient amount of alumina and transition metal species that are present as oxides at the anode surface.

WO 00/40783 (de Nora/Duruz) further describes the use of HSLA steel with a coherent and adherent oxide surface as an anode for aluminium electrowinning.

Nickel-iron alloy anodes with various additives are further described in WO 00/06803 (Duruz/de Nora/Crottaz), WO 00/006804 (Crottaz/Duruz), WO 01/42534 (de Nora/Duruz), WO 01/42535, (Duruz/de Nora), WO 01/42536 (Duruz/Nguyen/de Nora) and WO02/083991 (Nguyen/de Nora).

SUMMARY OF THE INVENTION

An object of the invention is to provide a nickel-iron alloy-based anode for aluminium electrowinning having a long life, which anode during use does not contaminate the product aluminium beyond an acceptable level.

The invention relates to an alloy-based anode for the electrowinning of aluminium by the electrolysis of alumina in a molten fluoride electrolyte. The anode has an electrochemically active integral outside oxide layer obtainable by surface oxidation of a metal alloy having a composition adjusted to achieve the effect described below. This metal alloy consists of:

- 20 to 60, preferably 35 to 60, weight % nickel;
- 5 to 15, preferably 6 to 12, weight % copper;
- 1.5 to 5, preferably 1.5 to 4, weight % aluminium;
- 0 to 2, preferably 0.2 to 0.5, weight % in total of one or more rare earth metals, in particular yttrium;
- 0 to 2, usually 0.5 to 1.5, weight % of further elements, in particular manganese, silicon and carbon; and
- the balance being iron, the metal alloy having a copper/nickel weight ratio in the range of 0.1 to 0.5, preferably 0.2 to 0.3.

When such a metal alloy is exposed to an oxidising atmosphere at elevated temperature, e.g. above 600° C., typically 700° to 1000° C., for a duration of up to 36 hours depending on the temperature, and/or during use in an aluminium production cell, the iron migrates from an outer part to the surface where it is oxidised.

When the anode's alloy is oxidised before use, the integral oxide layer formed thereon usually consists essentially of iron oxides and up 30 weight % nickel oxide, in particular from 1 to 10, weight %.

Whether or not the alloy is oxidised before use, the integral oxide layer typically comprises during use in a cell an iron-rich outer portion which consists essentially of non-stoichiometric well conductive iron oxide ($FeO_x$) and nickel oxide in a metal equivalent weight ratio that is at least 9 iron for 1 nickel, and an iron-rich inner portion which consists essentially of a mixture of oxides of iron, nickel, copper and aluminium which are present in metal equivalent weight percentages of 65 or 70 to 80% iron, 15 to 25 or 30% nickel 2 to 3% copper and up to 1% aluminium. Usually, the outer portion of the integral oxide layer makes about ⅓ of the thickness of the layer, whereas the inner portion makes about ⅔ of the thickness of the integral oxide layer.

Underneath the electrochemically active oxide surface, the (iron-depleted) alloy outer part is rich in copper and nickel metal in a ratio derived from the nickel-copper ratio of the alloy's nominal composition and contains a limited amount of iron metal. The copper-nickel outer part controls the iron diffusion from inside the anode to its electrochemically active surface so as to compensate slow dissolution of iron oxides from the anode's active surface into the electrolyte while it prevents excessive iron diffusion to the anode's surface and dissolution into the electrolyte of an excess of iron oxide from the anode's surface, which would lead to premature iron depletion of the anode's alloy and unnecessary and unwanted contamination of the product aluminium.

Typically, the nickel-copper metal outer part has a nickel/copper weight ratio in the range of 1.8 to 4 upon heat treatment and/or during use in a cell.

The small amount of aluminium contained in the anode's alloy diffuses to the grain joints of the nickel-iron alloy inside the anode where it is oxidised to form a partial barrier against oxygen diffusion into the alloy's grains and iron diffusion therefrom. Thus, the combined effect of the alloy's aluminium on the one hand and of the anode's nickel-copper outer part on the other hand leads to a control of the supply of iron to the anode's active surface.

Small amounts of rare earth metals, such as yttrium, are preferably used in the anode's alloy to improve the anchorage of the integral oxide layer on the nickel-copper outer part. For example, the metal alloy contains 0.3 to 0.4 weight % yttrium.

The anode's metal alloy can contain 16 to 73.5 weight % iron, usually from 20 to 70 weight %. In particular in this case, the nickel/iron weight ratio can be in the range of 0.3 to 2.5.

In one embodiment the anode's metal alloy contains 30 to 70 weight % iron, preferably 40 to 60 weight %. Especially in this case, the nickel/iron weight ratio can be in the range of 0.3 or 0.4 to 1.5, preferably 0.7 to 1.2.

In another embodiment, the anode's metal alloy contains 20 to 40 weight % iron, preferably 25 to 35 weight %. Particularly in this case, the nickel/iron weight ratio may be in the range of 1.5 to 3, preferably 2 to 2.5.

Especially when the anode is used with an electrolyte in a reduced temperature range, e.g. from 850-880° to 940° C., the anode's alloy preferably contains at least one of the metals nickel, copper, aluminium and iron in the respective amounts: 35 to 50 weight % nickel; 6 to 10 weight % copper; 3 to 4 weight % aluminium; and 32 to 56 weight % iron, in particular 35 to 55 weight % iron. For instance, the alloy contains: 35 to 50 weight % nickel; 6 to 10 weight % copper; 3 to 4 weight % aluminium; 32 to 56 weight % iron, in particular 35 to 55 weight % iron; and 0 to 4 weight % in total of further elements, i.e. the rare earth metals plus the abovementioned further elements.

Especially when the anode is used with an electrolyte in a higher temperature range, e.g. from 910° to 960° C. such as 930° to 950° C., the anode's alloy preferably contains at least one of the metals nickel, copper, aluminium and iron in the respective amounts: 50 to 60 weight % nickel, in particular 55 to 60 weight %; 7 to 12 weight % copper; 1.5 to 3 weight % aluminium; and 21 to 41.5 weight % iron, preferably 21 to 36.5 weight %. In particular, the alloy contains: 50 to 60 weight % nickel, in particular 55 to 60 weight %; 7 to 12 weight % copper; 1.5 to 3 weight % aluminium; and 21 to 41.5 weight % iron, preferably 21 to 36.5 weight %; and 0 to 4 weight % in total of further elements (the rare earth metals plus the abovementioned further elements).

Advantageously, the metal alloy contains manganese to trap and solubilise in the alloy sulphur that can be present as an impurity in the electrolyte. In the absence of manganese, sulphur combines with nickel to from NiS instead of MnS and migrates to the grain joints of the alloy and impairs its properties. The alloy preferably contains manganese in an amount of less than 1 weight %, in particular from 0.2 to 0.5 weight %.

When the metal alloy is cast, especially to produce complex shapes, silicon can be used to lower the viscosity of the alloy and enhance its castability. It is not unusual to find 0.2 to 0.7 weight % silicon in the metal alloy when it is cast.

Furthermore, to avoid oxidation of the metal alloy when it is cast, carbon can be used to trap any oxygen to which the alloy may be exposed during casting. Therefore, residual amounts of carbon, typically 0.01 to 0.2 weight %, is commonly found in such alloys.

For example, the metal alloy consists of 41 to 49 weight % nickel, 41 to 49 weight % iron, 6 to 8 weight % copper, 2.5 to 3.5 weight % aluminium and 0 to 2 weight % in total of further elements (the rare earth metals plus the abovementioned further elements). The metal alloy can also consist of 33 to 39 weight % nickel, 49 to 59 weight % iron, 6 to 8 weight % copper, 2.5 to 3.5 weight % aluminium and 0 to 2 weight % in total of further elements (the rare earth metals plus the abovementioned further elements).

The anode's metal alloy can contain 0 to 1.5 weight % in total of further elements (the rare earth metals plus the abovementioned further elements), preferably no more than about 1 weight %.

In another embodiment, the anode's alloy consists of 56 to 58 weight % nickel, 28 to 32 weight % iron, 9 to 11 weight % copper, 1.5 to 2.5 weight % aluminium and 0 to 1 or 1.5 weight % in total of further elements (the rare earth metals plus the abovementioned further elements).

The anode is preferably covered with a protective coating on the integral oxide layer, in particular a protective oxide coating. Suitable oxide coatings may contain iron oxide such as hematite ($Fe_2O_3$), in particular a coating made of hematite and at least one oxide selected from oxides of titanium, yttrium, ytterbium and tantalum as disclosed in PCT/IB02/02973 (Nguyen/de Nora). Other suitable coatings can be used to protect the anode's alloy, in particular oxide coatings as disclosed in WO99/36594 (de Nora/Duruz), U.S. Pat. No. 6,077,415 (Duruz/de Nora), U.S. Pat. No. 6,103,090 (de Nora) U.S. Pat. No. 6,361,681 (de Nora/Duruz), U.S. Pat. No. 6,365,018 (de Nora), or cerium-based coatings, especially for use in an electrolyte in a higher temperature range, e.g. in the range of 910° to 960° C., for example the cerium-based coatings disclosed in U.S. Pat. No. 4,614,569 (Duruz/Derivaz/Debely/Adorian), U.S. Pat. No. 4,966,674 (Bannochie/Sheriff), U.S. Pat. Nos. 4,683,037 and 4,680,094 (both in the name of Duruz), U.S. Pat. Nos. 4,960,494, 4,956,068 and 5,069,771 (all in the name of Nyguen/Lazouni/Doan), and WO02/070786 (Nguyen/de Nora) and WO02/083990 (de Nora/Nguyen).

Unless specified otherwise, all the above mentioned metal percentages of the alloy refer to the nominal alloy composition, i.e. before any heat treatment or use in a cell.

The invention relates also to an aluminium electrowinning cell comprising at least one anode as described above.

Advantageously, the cell comprises an aluminium-wettable cathode, in particular a drained cathode. Suitable aluminium-wettable cathode materials are disclosed in WO01/42168 (de Nora/Duruz), WO01/42531 (Nguyen/Duruz/de Nora), WO02/070783 (de Nora), WO02/096830 (Duruz/Nguyen/de Nora) and WO02/096831 (Nguyen/de Nora). Suitable drained cathode designs are disclosed in U.S Pat. No. 5,683,559 (de Nora) and U.S. Pat. No. 6,258,246 (Duruz/de Nora), and in PCT applications WO99/02764, WO99/41429 (both de Nora/Duruz), WO00/63463 (de Nora), WO01/31086 (de Nora/Duruz), WO01/31088 (de Nora), WO02/070785 (de Nora), WO02/097168 (de Nora) and WO02/097169 (de Nora).

Another aspect of the invention relates to a method of electrowinning aluminium. The method comprises passing an electrolysis current in a molten electrolyte containing dissolved alumina between a cathode and an anode as described above to produce aluminium cathodically and oxygen anodically.

During cell operation, oxides of the anode's oxide layer may slowly dissolve in the electrolyte, the oxide layer being maintained by slow oxidation of the anode's metal alloy at the oxide layer/metal alloy interface. Advantageously, the dissolution rate of the anode's oxides is substantially equal to the oxidation rate of the metal alloy at the oxide layer/metal alloy interface, as taught in U.S. Pat. No. 6,248,227 and WO00/06805 (both de Nora/Duruz).

Alternatively, dissolution of oxides of the anode's oxide layer can be inhibited, in particular prevented, by maintaining in the electrolyte an amount of alumina and iron species, preferably at a level close to or at saturation, as disclosed in WO00/06802 (Duruz/de Nora/Crottaz).

Preferably, the electrolyte has a temperature which is maintained sufficiently low to limit the solubility of iron species in the electrolyte and the contamination of the product aluminium to an acceptable level. The electrolyte temperature of the cell may be in a reduced temperature range, typically from 850° C. to 940° C., preferably between 880° C. and 930° C. Alternatively, the electrolyte temperature may be in a higher temperature range, typically in the range of 910° C. to 960° C., in particular from 930° C. to 950° C.

The electrolyte can contain sodium fluoride (NaF) and aluminium fluoride ($AlF_3$) in a molar ratio in the range from 1.2 to 2.4, in particular from 1.4 to 1.9 with an electrolyte in a reduced temperature range and from 1.7 to 2.3 with an electrolyte in a higher temperature range. Suitable electrolyte compositions are disclosed in WO02/097168 (de Nora).

Advantageously, the electrolyte is continuously circulated from an alumina feeding area where it is enriched with alumina to the anode where the alumina is electrolysed and from the anode back to the alumina feeding area so as to maintain a high alumina concentration near the anode. Means for providing such a circulation are disclosed in WO99/41429 (de Nora/Duruz), WO00/40781, WO00/40781 and WO03/006716 (all de Nora).

A further aspect of the invention relates to an alloy, in particular for use to produce an anode for the electrowinning of aluminium. The alloy consists of:

20 to 60, preferably 35 to 60, weight % nickel;
5 to 15, preferably 6 to 12, weight % copper;
1.5 to 5, preferably 1.5 to 4, weight % aluminium;
0 to 2, preferably 0.2 to 0.5, weight % in total of one or more rare earth metals, in particular yttrium;
0 to 2, usually 0.5 to 1.5, weight % of further elements, in particular manganese, silicon and carbon; and
the balance being iron, the alloy having a copper/nickel weight ratio in the range of 0.1 to 0.5, preferably 0.2 to 0.3.

The alloy can contain at least one of the metals nickel, copper, aluminium and iron in the respective amounts: 35 to 50 weight % nickel; 6 to 10 weight % copper; 3 to 4 weight % aluminium; and 32 to 56 weight % iron, in particular 35 to 55 weight % iron. In particular, the alloy contains: 35 to 50 weight % nickel; 6 to 10 weight % copper; 3 to 4 weight % aluminium; 32 to 56 weight % iron, in particular 35 to 55 weight % iron; and 0 to 4 weight % in total of further elements (the rare earth metals plus the abovementioned further elements).

The alloy may also contain at least one of the metals nickel, copper, aluminium and iron in the respective amounts: 50 to 60 weight % nickel, in particular 55 to 60 weight %; 7 to 12 weight % copper; 1.5 to 3 weight % aluminium; and 21 to 41.5 weight % iron, preferably 21 to 36.5 weight %. In particular, the alloy contains: 50 to 60 weight % nickel, in particular 55 to 60 weight %; 7 to 12 weight % copper; and 1.5 to 3 weight % aluminium; 21 to 41.5 weight % iron, preferably 21 to 36.5 weight %; and 0 to 4 weight % in total of further elements (the rare earth metals plus the abovementioned further elements).

Another aspect of the invention relates to an anode starter for the electrowinning of aluminium having an outer part made of the alloy described above which is oxidisable before and/or during use to form an integral electrochemically active oxide outer layer.

A further aspect of the invention relates to a component of an aluminium electrowinning cell, in particular an anode support member or a current distribution member. This cell component has an outer part made of the alloy described above which is oxidisable before and/or during use to form an integral oxide outer layer.

DETAILED DESCRIPTION

Examples of anode alloy compositions according to the invention are given in Table I, which shows the weight percentages of the indicated metals for each specimen A-R.

TABLE I

| | Ni | Fe | Cu | Al | Y | Mn | Si | C |
|---|---|---|---|---|---|---|---|---|
| A | 48 | 38 | 10 | 3 | — | 0.5 | 0.45 | 0.05 |
| B | 49 | 40 | 7 | 3 | — | 0.5 | 0.45 | 0.05 |
| C | 36 | 50 | 10 | 3 | — | 0.5 | 0.45 | 0.05 |
| D | 36 | 50 | 10 | 3 | 0.35 | 0.3 | 0.3 | 0.05 |
| E | 36 | 53 | 7 | 3 | — | 0.5 | 0.45 | 0.05 |
| F | 36 | 53 | 7 | 3 | 0.35 | 0.3 | 0.3 | 0.05 |
| G | 48 | 38 | 10 | 3 | 0.35 | 0.3 | 0.3 | 0.05 |
| H | 48 | 38 | 10 | 3 | 0.2 | 0.3 | 0.45 | 0.05 |
| I | 22 | 68 | 5.5 | 4 | — | 0.25 | 0.2 | 0.05 |

TABLE I-continued

| | Ni | Fe | Cu | Al | Y | Mn | Si | C |
|---|---|---|---|---|---|---|---|---|
| J | 22 | 69 | 5.5 | 3 | — | 0.25 | 0.2 | 0.05 |
| K | 42 | 42 | 12 | 2 | 1 | 0.5 | 0.45 | 0.05 |
| L | 42 | 40 | 12.5 | 4 | 0.4 | 0.45 | 0.6 | 0.05 |
| M | 45 | 44 | 7 | 3 | — | 0.5 | 0.45 | 0.05 |
| N | 55 | 30 | 12 | 2 | 0.2 | 0.3 | 0.45 | 0.05 |
| O | 53 | 36 | 8 | 2.3 | 0.1 | 0.2 | 0.35 | 0.05 |
| P | 55 | 32 | 10 | 2 | 0.2 | 0.3 | 0.45 | 0.05 |
| Q | 57 | 30 | 10 | 2 | 0.2 | 0.3 | 0.45 | 0.05 |
| R | 59 | 27 | 10 | 3 | 0.2 | 0.3 | 0.45 | 0.05 |

The invention will be further described in the following Examples.

EXAMPLE 1

An anode rod of diameter 20 mm and total length 200 mm was prepared by casting the composition of Sample A of Table I, using a sand mould. The anode was oxidised in air for 24 hours at 700° C.

Electrolysis was carried out in a laboratory scale cell equipped with this oxidised anode immersed to a depth of 50 mm in a fluoride-containing molten electrolyte at 920° to 930° C. The electrolyte consisted of 16 weight % aluminium fluoride ($AlF_3$) and 7 weight % alumina $Al_2O_3$ and 4 weight % $CaF_2$, the balance being cryolite ($3NaF—AlF_3$).

The current density was about 0.8 A/cm$^2$ at a cell voltage of 3.5 to 3.8 V. The concentration of dissolved alumina in the electrolyte was maintained during the entire electrolysis by periodically feeding fresh alumina into the cell.

After 150 hours electrolysis was interrupted and the anode extracted. Upon cooling the anode was examined externally and in cross-section.

The anode's outer dimensions had remained substantially unchanged.

The anode was covered with an external oxide scale having a thickness of about 50-100 micron. The oxide scale had an outer portion that consisted essentially of non-stoichiometric iron oxide ($FeO_x$) with small amounts of nickel oxide (metal equivalent of about 90 weight % Fe and 10 weight % Ni) at its surface which is electrochemically active during use. Below the outer portion, the external oxide scale had an inner portion that consisted essentially of a mixture of hematite ($Fe_2O_3$) and mixed oxides of nickel, iron and aluminium.

Underneath the oxide scale, the anode's alloy had become vermicular over a depth of about 1500 micron and contained 75 weight % nickel and 15 weight % copper, the balance being essentially iron (below 10 weight %). The vermicular outer part of the alloy had elongated pores having a diameter of 3 to 5 micron and a length of 10 to 30 micron and containing oxides essentially of iron. Below the anode's vermicular part the alloy was non vermicular but had the same metal alloy composition as the vermicular outer part over a depth of about 50 micron followed by an unchanged inner part having the nominal composition of the alloy before heat treatment.

The alloy grain joints were oxidised all over the vermicular outer part and to a depth of about 100 micron therebelow.

EXAMPLE 1a

An anode rod of diameter 20 mm and total length 20 mm was prepared by casting the composition of Sample B of Table I, using a sand mould. The anode was oxidised in air for 24 hours at 700° C. and then tested in a laboratory scale cell as in Example 1.

Similar results were obtained as in Example 1 except that the wear rate of the anode had increased to about 1 mm per 100 hours of use.

EXAMPLE 2

An anode rod of diameter 20 mm and total length 200 mm was prepared by casting the composition of Sample N of Table I, using a sand mould. The anode was oxidised in air for 24 hours at 750° C.

Electrolysis was carried out in a laboratory scale cell equipped with this oxidised anode immersed to a depth of 50 mm in a fluoride-containing molten electrolyte at about 940° C. The electrolyte consisted of 15 weight % aluminium fluoride ($AlF_3$) and 7 weight % alumina $Al_2O_3$ and 4 weight % $CaF_2$, the balance being cryolite ($3NaF—AlF_3$).

The current density was about 0.8 A/cm$^2$ at a cell voltage of 3.5 to 3.8 V. The concentration of dissolved alumina in the electrolyte was maintained during the entire electrolysis by periodically feeding fresh alumina into the cell.

After 200 hours electrolysis was interrupted and the anode extracted. Upon cooling the anode was examined externally and in cross-section.

The anode's outer dimensions had remained substantially unchanged.

The anode was covered with an external oxide scale having a thickness of about 50-100 micron. The oxide scale had an outer portion that consisted essentially of non-stoichiometric iron oxide ($FeO_x$) with small amounts of nickel oxide (metal equivalent of about 70 weight % Fe and 30 weight % Ni) at its surface which is electrochemically active during use. Below the outer portion, the external oxide scale had an inner portion that consisted essentially of a mixture of hematite ($Fe_2O_3$) and mixed oxides of nickel, iron and aluminium.

Underneath the oxide scale and over a depth of about 150 micron, the anode's alloy was nearly non-porous and contained about 70-75 weight % nickel and 20 weight % copper, the balance being essentially iron (below 10 weight %). Therebelow, the anode's alloy had remained unchanged (nominal composition of sample N before heat treatment).

The alloy grain joints were nearly not oxidised, unlike those of Example 1a.

EXAMPLE 3

An anode rod of diameter 20 mm and total length 200 mm was prepared by casting the composition of Sample N of Table I, using a sand mould.

A slurry for the application of a protective coating onto the anode rod was prepared by suspending a particle mixture of $Fe_2O_3$ particles (−325 mesh, i.e. smaller than 44 micron) and $TiO_2$ particles (−325 mesh) in colloidal alumina (NYACOL® Al-20, a milky liquid with a colloidal particle size of about 40 to 60 nanometer and containing 20 weight % colloidal particle and 80 weight % liquid solution) in a weight ratio $Fe_2O_3$:$TiO_2$:colloid of 40:20:40. The pH of the slurry was adjusted at 4 by adding a few drops of $HNO_3$ to avoid gelling of the slurry.

The anode rod was covered with several layers of this slurry using a brush. The applied layers were dried for 10 hours at 140° C. The dried layers formed a coating of about 350-450 micron thick on the anode rod.

The anode rod was pre-heated over a molten electrolyte for an hour. During pre-heating at about 900°-950° C., the coating was further consolidated by reactive sintering of the iron oxide and the titanium oxide. During the pre-heating or at the latest at the beginning of use in the electrolyte, the coating became substantially continuous and thoroughly reacted forming a protective multiple oxide matrix of $Fe_2O_3$ and $TiO_2$. Underneath the protective coating, an integral oxide scale mainly of iron oxide was grown from the alloy rod during the heat treatment and reacted with $TiO_2$ from the coating to firmly anchor the coating to the anode rod. The reacted integral oxide scale contained titanium oxide in an amount of about 10 metal weight %. Minor amounts of copper, aluminium and nickel were also found in the oxide scale (less that 5 metal weight % in total).

Electrolysis was carried out as in Example 2. The current density was about 0.8 A/cm$^2$ at a reduced cell voltage of 3.1 to 3.3 V.

After 200 hours electrolysis was interrupted and the anode extracted. Upon cooling the anode was examined and no significant change was observed.

Samples of the used electrolyte and the product aluminium were analysed. It was found that the electrolyte was nickel-free and the produced aluminium contained less than 300 ppm nickel. This demonstrated that the $Fe_2O_3$—$TiO_2$ coating constituted an efficient barrier against nickel dissolution from the anode's alloy.

EXAMPLE 4

Anode rods can be prepared, as in Examples 1, 1a and 2, respectively, by casting using sand moulds and oxidising in air the composition of Table I's Samples C to M and O to R, respectively, and as in Example 3 by casting and coating the composition of Table I's Samples A to M and O to R. Thereafter, the anode rods can be tested in laboratory scale cells as in Examples 1 to 3.

EXAMPLE 5

Examples 1, 1a and 2 and their variations disclosed in Example 4 can be repeated without oxidation of the anode rods before use.

The invention claimed is:

1. An alloy-based anode for the electrowinning of aluminium by the electrolysis of alumina in a molten fluoride electrolyte, having an electrochemically active integral outside oxide layer obtainable by surface oxidation of a metal alloy which consists of:

20 to 60, preferably 35 to 60, weight % nickel;

5 to 15, preferably 6 to 12, weight % copper;

1.5 to 5, preferably 1.5 to 4, weight % aluminium;

0 to 2, preferably 0.2 to 0.5, weight % in total of one or more rare earth metals, in particular yttrium;

0 to 2, usually 0.5 to 1.5, weight % of further elements, in particular manganese, silicon and carbon; and the balance being iron, in an amount 25 to 70, preferably 40 to 60, weight %, and which has a copper/nickel weight ratio in the range of 0.1 to 0.5, preferably 0.2 to 0.3.

2. The anode of claim 1, wherein said metal alloy has a nickel/iron weight ratio in the range of 0.3 to 1.5, preferably 0.7 to 1.2.

3. The anode of claim 1, wherein said metal alloy has a nickel/iron weight ratio in the range of 1.5 to 2.4.

4. The anode of claim 1, wherein said metal alloy contains at least one of the metals nickel, copper, aluminium and iron in the respective amounts: 35 to 50 weight % nickel; 6 to 10 weight % copper; 3 to 4 weight % aluminium; and 32 to 56 weight % iron, in particular 35 to 55 weight % iron.

5. The anode of claim 4, wherein said metal alloy contains: 35 to 50 weight % nickel; 6 to 10 weight % copper; 3 to 4 weight % aluminium; 32 to 56 weight % iron, in particular 35 to 55 weight % iron; and 0 to 4 weight % in total of further elements.

6. The anode of claim 1, wherein said metal alloy contains at least one of the metals nickel, copper, aluminium and iron in the respective amounts: 50 to 60 weight % nickel, in particular 55 to 60 weight %; 7 to 12 weight % copper; 1.5 to 3 weight % aluminium; and 25 to 41.5 weight % iron, in particular 25 to 36.5 weight %.

7. The anode of claim 6, wherein said metal alloy contains: 50 to 60 weight % nickel, in particular 55 to 60 weight %; 7 to 12 weight % copper; 1.5 to 3 weight % aluminium; 25 to 41.5 weight % iron, in particular 25 to 36.5 weight %; and 0 to 4 weight % in total of further elements.

8. The anode of claim 1, wherein said metal alloy contains yttrium in an amount of 0.3 to 0.4 weight %.

9. The anode of claim 1, wherein said metal alloy contains manganese in an amount of less than 1 weight %, in particular from 0.2 to 0.6 weight %.

10. The anode of claim 1, wherein said metal alloy contains silicon in an amount of 0.2 to 0.7 weight %.

11. The anode of claim 1, wherein said metal alloy contains carbon in an amount of 0.01 to 0.2 weight %.

12. The anode of claim 1, wherein said metal alloy consists of 41 to 49 weight % nickel, 41 to 49 weight % iron, 6 to 8 weight % copper, 2.5 to 3.5 weight % aluminium and 0 to 2 weight % in total of further elements.

13. The anode of claim 1, wherein said metal alloy consists of 33 to 39 weight % nickel, 49 to 59 weight % iron, 6 to 8 weight % copper, 2.5 to 3.5 weight % aluminium and 0 to 2 weight % in total of further elements.

14. The anode of claim 1, wherein said metal alloy contains 0 to 1.5 weight %, preferably no more than about 1 weight %, in total of further elements.

15. The anode of claim 1, wherein said metal alloy consists of 56 to 58 weight % nickel, 28 to 32 weight % iron, 9 to 11 weight % copper, 1.5 to 2.5 weight % aluminium and 0 to 1.5 weight % in total of further elements, preferably no more than 1 weight %.

16. The anode of claim 1, comprising a protective coating on the integral oxide layer, in particular a protective oxide coating.

17. An aluminium electrowinning cell comprising at least one anode as defined in claim 1.

18. The cell of claim 17, comprising an aluminium-wettable cathode, in particular a drained cathode.

19. A method of electrowinning aluminium comprising passing an electrolysis current in a molten electrolyte containing dissolved alumina between a cathode and an anode according to claim 1 to produce aluminium cathodically and oxygen anodically.

20. The method of claim 19, wherein oxides of the anode's oxide layer slowly dissolve in the electrolyte, the oxide layer being maintained by slow oxidation of the anode's metal alloy at the oxide layer/metal alloy interface.

21. The method of claim 20, wherein the dissolution rate of the anode's oxides is substantially equal to the oxidation rate of the metal alloy at the oxide layer/metal alloy interface.

22. The method of claim 19, wherein dissolution of oxides of the anode's oxide layer is inhibited by maintaining in the electrolyte an amount of alumina and iron species, preferably at a level close to or at saturation.

23. The method of claim 19, wherein the electrolyte has a temperature which is maintained sufficiently low to limit the solubility of iron species in the electrolyte and the contamination of the product aluminium to an acceptable level.

24. The method of claim 23, wherein the electrolyte temperature is below 940° C., preferably from 880° C. to 930° C.

25. The method of claim 23, wherein the cell comprises an anode whose said metal alloy contains at least one of the metals nickel, copper, aluminium and iron in the respective amounts: 35 to 50 weight % nickel; 6 to 10 weight % copper; 3 to 4 weight % aluminium; and 32 to 56 weight % iron, in particular 35 to 55 weight % iron.

26. The method of claim 23, wherein the electrolyte temperature is from 910° C. to 960° C., preferably from 930° C. to 950° C.

27. The method of claim 26, wherein the cell comprises an anode whose said metal alloy contains at least one of the metals nickel, copper, aluminium and iron in the respective amounts: 50 to 60 weight % nickel, in particular 55 to 60 weight %; 7 to 12 weight % copper; 1.5 to 3 weight % aluminium; and 25 to 41.5 weight % iron, in particular 25 to 36.5 weight %.

28. The method of claim 26, wherein the cell comprises an anode whose said metal alloy contains: 50 to 60 weight % nickel, in particular 55 to 60 weight %; 7 to 12 weight % copper; 1.5 to 3 weight % aluminium; 25 to 41.5 weight % iron, in particular 25 to 36.5 weight %; and 0 to 4 weight % in total of further elements.

29. The method of claim 26, wherein the cell comprises an anode whose said metal alloy consists of 56 to 58 weight % nickel, 28 to 32 weight % iron, 9 to 11 weight % copper, 1.5 to 2.5 weight % aluminium and 0 to 1.5 weight % in total of further elements, preferably no more than 1 weight %.

30. The method of claim 23, wherein the cell comprises an anode whose said metal alloy contains: 35 to 50 weight % nickel; 6 to 10 weight % copper; 3 to 4 weight % aluminium; 32 to 56 weight % iron, in particular 35 to 55 weight % iron; and 0 to 4 weight % in total of further elements.

31. The method of claim 23, wherein the cell comprises an anode whose said metal alloy consists of 41 to 49 weight % nickel, 41 to 49 weight % iron, 6 to 8 weight % copper, 2.5 to 3.5 weight % aluminium and 0 to 2 weight % in total of further elements.

32. The method of claim 23, wherein the cell comprises an anode whose said metal alloy consists of 33 to 39 weight % nickel, 49 to 59 weight % iron, 6 to 8 weight % copper, 2.5 to 3.5 weight % aluminium and 0 to 2 weight % in total of further elements.

33. The method of claim 19, wherein the electrolyte contains NaF and $AlF_3$ in a molar ratio in the range from 1.2 to 2.4.

34. The method of claim 19, comprising continuously circulating the electrolyte from an alumina feeding area where it is enriched with alumina to the anode where the alumina is electrolysed and from the anode back to the alumina feeding area so as to maintain a high alumina concentration near the anode.

35. An alloy, in particular for use to produce an anode for the electrowinning of aluminium, consisting of:

20 to 60, preferably 35 to 60, weight % nickel;

5 to 15, preferably 6 to 12, weight % copper;

1.5 to 5, preferably 1.5 to 4, weight % aluminium;

0 to 2, preferably 0.2 to 0.5, weight % in total of one or more rare earth metals, in particular yttrium;

0 to 2, usually 0.5 to 1.5, weight % of further elements, in particular manganese, silicon and carbon; and the balance being iron, in an amount 25 to 70, preferably 40 to 60, weight %, and which has a copper/nickel weight ratio in the range of 0.1 to 0.5, preferably 0.2 to 0.3.

36. The alloy of claim 35, which contains at least one of the metals nickel, copper, aluminium and iron in the respective amounts: 35 to 50 weight % nickel; 6 to 10 weight % copper; 3 to 4 weight % aluminium; and 32 to 56 weight % iron, in particular 35 to 55 weight % iron.

37. The alloy of claim 36, which contains: 35 to 50 weight % nickel; 6 to 10 weight % copper; 3 to 4 weight % aluminium; 32 to 56 weight % iron, in particular 35 to 55 weight % iron; and 0 to 4 weight % in total of further elements.

38. The alloy of claim 35, which contains at least one metal from the group consisting of nickel, copper, aluminium and iron in the following amounts: 50 to 60 weight % nickel, in particular 55 to 60 weight %; 7 to 12 weight % copper; 1.5 to 3 weight % aluminium; and 25 to 41.5 weight % iron, in particular 21 to 36.5 weight %.

39. The alloy of claim 38, which contains: 50 to 60 weight % nickel, in particular 55 to 60 weight %; 7 to 12 weight % copper; 1.5 to 3 weight % aluminium; 25 to 41.5 weight % iron, in particular 25 to 36.5 weight %; and 0 to 4 weight % in total of further elements.

40. An anode starter for the electrowinning of aluminium having an outer part made of the alloy of claim 35 which is oxidisable before and/or during use to form an integral electrochemically active oxide outer layer.

41. A component of an aluminium electrowinning cell, in particular an anode support member or a current distribution member, having an outer part made of the alloy of claim 35 which is oxidisable before and/or during use to form an integral oxide outer layer.

* * * * *